United States Patent [19]

Nott et al.

[11] Patent Number: 5,000,798

[45] Date of Patent: Mar. 19, 1991

[54] METHOD FOR SHAPE CONTROL OF RAIL DURING ACCELERATED COOLING

[75] Inventors: Murray A. Nott; Kenneth Overman, both of Sault Ste. Marie, Canada

[73] Assignee: The Algoma Steel Corporation, Limited, Sault Ste. Marie, Canada

[21] Appl. No.: 432,981

[22] Filed: Nov. 7, 1989

[51] Int. Cl.[5] ..... C21D 9/04

[52] U.S. Cl. ..... 148/146; 148/12 B; 148/145; 148/152

[58] Field of Search ..... 148/145, 146, 152, 12 B

[56] References Cited

U.S. PATENT DOCUMENTS

| | | | |
|---|---|---|---|
| 4,486,248 | 12/1984 | Ackert et al. | 148/146 |
| 4,575,397 | 3/1986 | Heller | 148/144 |
| 4,749,419 | 6/1988 | Sommer et al. | 148/146 |
| 4,810,311 | 3/1989 | Economopoulos | 148/146 |
| 4,886,558 | 12/1989 | Teramoto et al. | 148/146 |

FOREIGN PATENT DOCUMENTS

| | | | |
|---|---|---|---|
| 1259552 | 9/1989 | Canada . | |
| 0186375 | 7/1986 | European Pat. Off. | 148/146 |
| 0050124 | 3/1984 | Japan | 148/146 |
| 0657883 | 4/1979 | U.S.S.R. | 148/146 |
| 0914645 | 3/1982 | U.S.S.R. | 148/146 |

*Primary Examiner*—Upendra Roy

*Attorney, Agent, or Firm*—Barrigar & Oyen

[57] ABSTRACT

A method and apparatus for controlling the shape of a hot railroad rail during accelerated cooling of the rail head. The railroad rail is cooled along its web-base junction at a rate which achieves a pre-selected degree of shape control, while avoiding over-cooling of the upper portion of the web or the tips of the rail base. The apparatus comprises spray means for applying selected volumes of coolant to the web-base junction of the rail oriented about the periphery of the rail. Such apparatus may be used to shape a rail during the accelerated cooling thereof in line with a rolling mill.

12 Claims, 3 Drawing Sheets

METHOD FOR SHAPE CONTROL OF RAIL DURING ACCELERATED COOLING

FIELD OF THE INVENTION

This invention relates to a method and apparatus for controlling the shape of hot railroad rails during accelerated cooling thereof, and more specifically, a method and apparatus for controlling the shape of railroad rails during accelerated cooling thereof in line with a rolling mill.

BACKGROUND OF THE INVENTION

A railway rail tends to distort longitudinally (i.e. along its length) during the cooling from rolling temperature thereof, because of the asymmetric cross section of the typical railroad rail. Distortion is increased if there exists an uneven application of heat or cooling to different portions of the rail cross-section. Such longitudinal distortion is referred to as camber. There are a number of different types of camber, including up sweep, down sweep, or up-and- down sweep. "Up-sweep" is the out of straight condition that exists when a railroad rail is placed head up on a horizontal support and, as a result, such rail has ends that are higher than its middle. "Down-sweep" is the opposite of this condition. "Up-and-down sweep" is a combination of the above two conditions in the same rail. Side sweep is another form of longitudinal distortion not of concern during most heat treatment processes, since rails are symmetric about their vertical axis and the desired pattern of hardening is also usually symmetric about such axis.

The longitudinal shape of a rail may be controlled during an accelerated cooling process by the use of a restraining system wherein a plurality of rollers are used to maintain the longitudinal shape of the rail. Any such restraint system, however, will have certain drawbacks. The exertion of external force onto the rail can induce residual stress which, in turn, increases the possibility of rail failure in service. Secondly, a mechanical restraint system may introduce mechanical defects into the rail. These mechanical defects would lead to higher defect rates and if undetected, could become fracture initiation sources in use.

Apparatus for reducing rail camber caused by intermittently cooling the head portion of a hot railroad rail is disclosed by Ackert et al. in U.S. Pat. Nos. 4,486,248 and 4,611,789. Such apparatus includes means for cooling the bottom of the rail base, but not the tips thereof, and a roller system designed to restrain and transport the rail in a head-up longitudinally straight position. The rail bottom cooling means comprises means for spraying a liquid cooling medium onto the base bottom, to help balance thermal contraction and stresses associated with the metallurgical transformations occuring during forced cooling. However, the base of the rail can only undergo a limited amount of cooling without increasing the toe hardness to unacceptable levels, because cooling the base from the bottom draws heat from the toe of the rail base. The toes of rails are subject to rapid cooling (because of the large surface to volume ratio) and adding coolant to the base increases the heat sink seen by the toe of the rail base.

Another prior art method, disclosed in U.S. Pat. No. 4,668,308 to Economopoulos et al., involves cooling the entire periphery of the rail or cooling the web and base. The disadvantage of cooling the web completely is the loss of heat available for soak back into the head of the rail as described by Ackert et al. This lack of soak back would necessitate complex process control to produce consistently fine pearlite without encountering bainite or martensite. These complexities are avoided, by allowing uniform soak back from the upper rail web to the web-head junction, in the present invention.

SUMMARY OF THE INVENTION

It has been found that shape control of a rail during accelerated cooling thereof can be achieved without the disadvantages of prior art methods, by spraying a preselected target area including the web-base junction of the rail with a coolant during the accelerated cooling process.

Accordingly, the present invention is directed to a method for controlling the shape of a rail while the rail head of the rail is being subjected to an accelerated cooling process, comprising the steps of applying a fluid coolant spray to the web-base junction of the rail during the accelerated cooling process, in such a manner that cooling of the top portion of the web is minimized so as to facilitate heat soak back into the rail head and overcooling of the tips of the rail base is avoided to prevent the formation of martensite in the tips, wherein the amount of fluid coolant applied to the web-base junction is selected to achieve a desired degree of shape control.

The invention is also directed to an apparatus for controlling the shape of a rail while the rail head of the rail is being subjected to an accelerated cooling process comprising: spray means for applying a coolant spray to the web-base junction of the rail, wherein the spray means is spaced from the rail and angled relative to the rail so as to spray an envelope of coolant directly onto the web-base junction. The position of the spray means and the diameter of the envelope of coolant spray are selected so as to minimize the amount of coolant directly impinging upon both the upper portion of the web and the tips of the rail base. The volume of the coolant sprayed and the specific heat capacity of the coolant are selected to achieve a desired rail shape, once the rail is cooled to ambient temperature.

The present invention and the advantages thereof over the prior art will be better understood in the light of the following detailed description of the preferred and alternative embodiments, which are illustrated, by way of example only, in the accompanying drawings.

DETAILED DESCRIPTION OF VARIOUS EMBODIMENTS OF THE INVENTION

The shape control method of the present invention is adapted to control the shape of a rail while the rail head of the rail is being subjected to an accelerated cooling method, especially the method disclosed in U.S. Pat. No. 4,486,248 to Ackert, et al, assigned to The Algoma Steel Company, Limited. This patent discloses a process for producing railway rails having a desirable fine pearlite structure in the head portion, on a consistent basis, as such rails emerge from a conventional production rolling mill. This process, known as the AWC process, comprises the steps of subjecting the head portion of a rail at an initial temperature above the austentite to ferrite transformation temperature to intermittent forced cooling in such a manner that the near surface region of the rail is maintained essentially above the martensite transformation temperature, by passing the rail through a series of alternating cooling headers using a liquid cooling medium and air zones, and by then terminating application of the cooling medium when the rail head has reached a pre-determined cooling stop temperature above the martensite transformation temperature.

Figure 1:
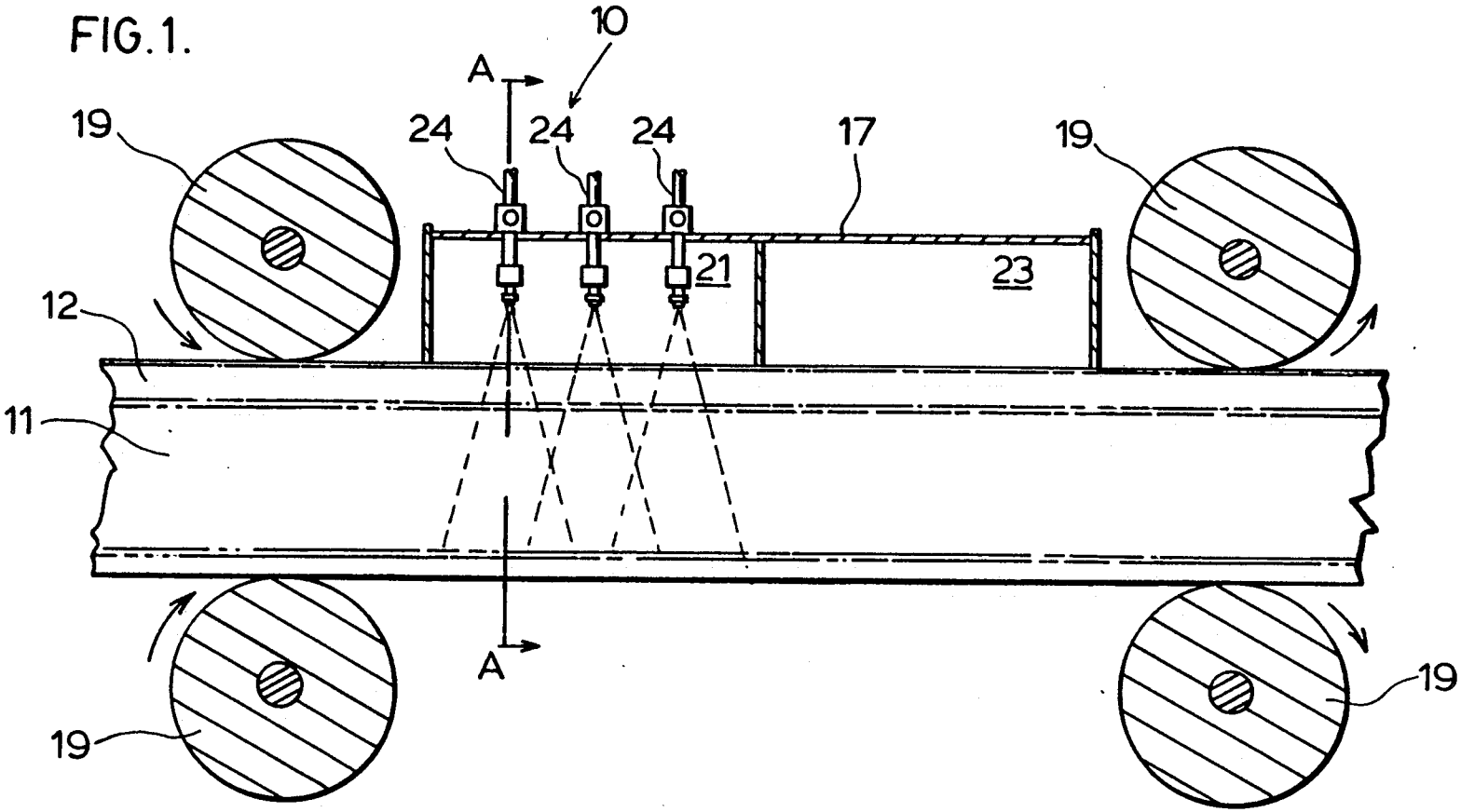
FIG. 1 is a sectional elevational view of the preferred embodiment of the apparatus of the present invention.

FIG. 1 depicts spray apparatus shown generally as 10, which is suitable for carrying out the rail shape control method of the present invention while the rail head 12 of the rail 11 is being subjected to the AWC process disclosed in the aforementioned U.S. patent to Ackert et al. Spray apparatus 10 comprises longitudinally spaced pairs of nozzles 24 mounted in a spray header 21 positioned between roller 19 and air zone 23.

Figure 2:
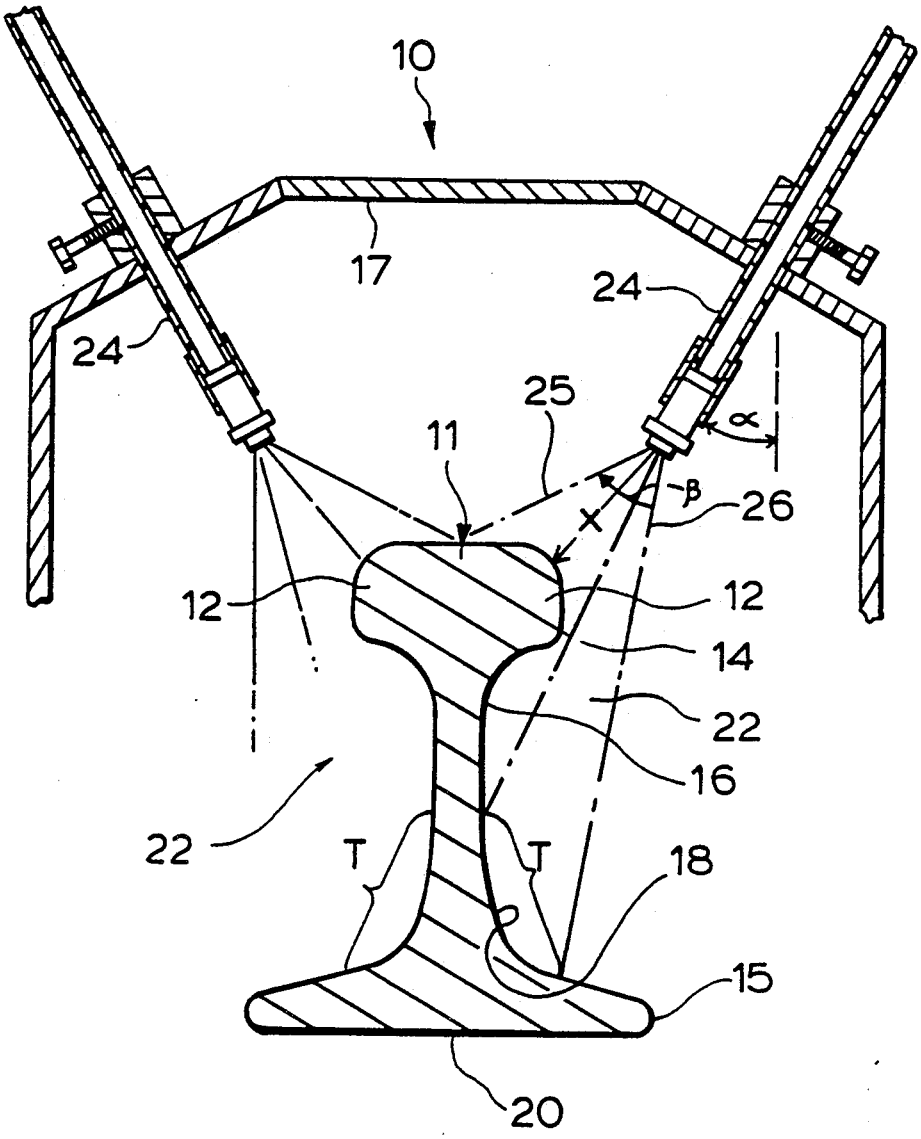
FIG. 2 is a sectional view taken along line A—A of FIG. 1.

Referring now to FIG. 2, spray apparatus 10 is adapted to apply coolant simultaneously to the sides of the rail head 12 for metallurgical reasons and to the web-base junction 18 for shape control. Nozzles 24, mounted onto shroud 17, spray an envelope of coolant spray shown generally as 22 onto rail 11. The side of the rail head 14 shadows the upper portion of the web 16 from the direct impingement of coolant spray. Nozzles 24 are located at a distance X from the rail head and are oriented at an angle $\alpha$ relative to the vertical. The width of envelope of coolant spray is indicated by rays 25 and 26, which define an angle $\beta$. Distance X, angle $\alpha$ angle $\beta$ are selected such that coolant directly impinges both upon the sides of the rail head 12 and upon a target area T surrounding the web-base junction 18 without impinging directly upon the tips 15 of the rail. The distance X and angles $\alpha$ and $\beta$ will vary (depending on rail size and geometry) to cover the target area.

The target area T to be subjected to direct impingment of coolant spray for shape control preferably includes the lower half of the web of the rail and a section of the base which extends to approximately one half of the distance from the web to the toe of the rail. Cooling outside of this preferred target area tends to adversely affect other rail properties. In particular, over-cooling of the tips of the base should be avoided, to avoid martensite formation in the tips. As well, over-cooling of the upper part of the web should be avoided, to prevent the formation of an abrupt transition between fine and coarse grain pearlite in the lower part of the head, and to facilitate heat soak back into the rail head in the case of accelerated cooling processes utilizing intermittent cooling.

Preferably, the target area is sprayed in an intermittent fashion, by nozzles which produce a relatively coarse spray pattern. This eliminates the need for the expensive and trouble-prone nozzles that are required to produce a fine spray or mist.

The fluid coolant spray used to cool the web-base junction is preferably ambient temperature water. However, other fluids, such as heated water, steam or forced air, as well as a solid suspended in a fluid, could be used depending upon the nature of the accelerated rail head cooling process.

The amount of coolant used to cool web-base junction may be altered to achieve the desired final shape or camber of the rail. The desired final shape will be dictated by the requirements of the process the rail must meet. For example, head-low shape may be required for a straightening process while a head-high profile may be required for a controlled cooling operation (to ensure hydrogen removal). The final shape required can be produced by altering the ratio of web-base junction cooling in relation to head cooling.

The coolant must be applied in a manner which ensures that an abrupt temperature change at the rail surface does not occur, but rather a gradual (but accelerated rate as opposed to still air cooling) drop in temperature of the treated region occurs. This will ensure a pearlitic structure and the exclusion of any undesirable structure. This has been achieved experimentally by the use of water sprays and air zones intermittently, i.e. in a manner essentially similar to that described by Ackert et al in U.S. Pat. No. 4,486,248.

It is believed that coolant which has contacted the hot web-base junction of the rail forms as beads of coolant which are suspended from the surface of the hot rail by a blanket of steam. Due to the slope of the web-base junction the beads of coolant travel past the tips 15 of the rail base 20 with sufficient speed such that the beads fly off the tips of the rail base 20 as the tip terminates. The blanket of steam separating the coolant beads and the surface of the rail prevents the over-cooling of the tips of the rail base 20. As a result, the formation of martensite in the tips of the rail base 20 is prevented.

When the shape control method of the present invention is used in conjunction with the AWC process of Algoma Steel, approximately four times as much coolant is applied to the rail head as is applied to the web-base junction. Without intentionally cooling the web-base junction of the rail, the rail cooled by the AWC process would exhibit approximately a six inch head-high camber in an 80 foot rail at ambient temperature following the head hardening process. With approximately one quarter of the head coolant applied to the web base junction in the manner herein described the rail has approximately a two inch head-low camber at ambient temperature. More than the one to four ratio gives a camber an excess of three to four inches head-low.

Figure 3:
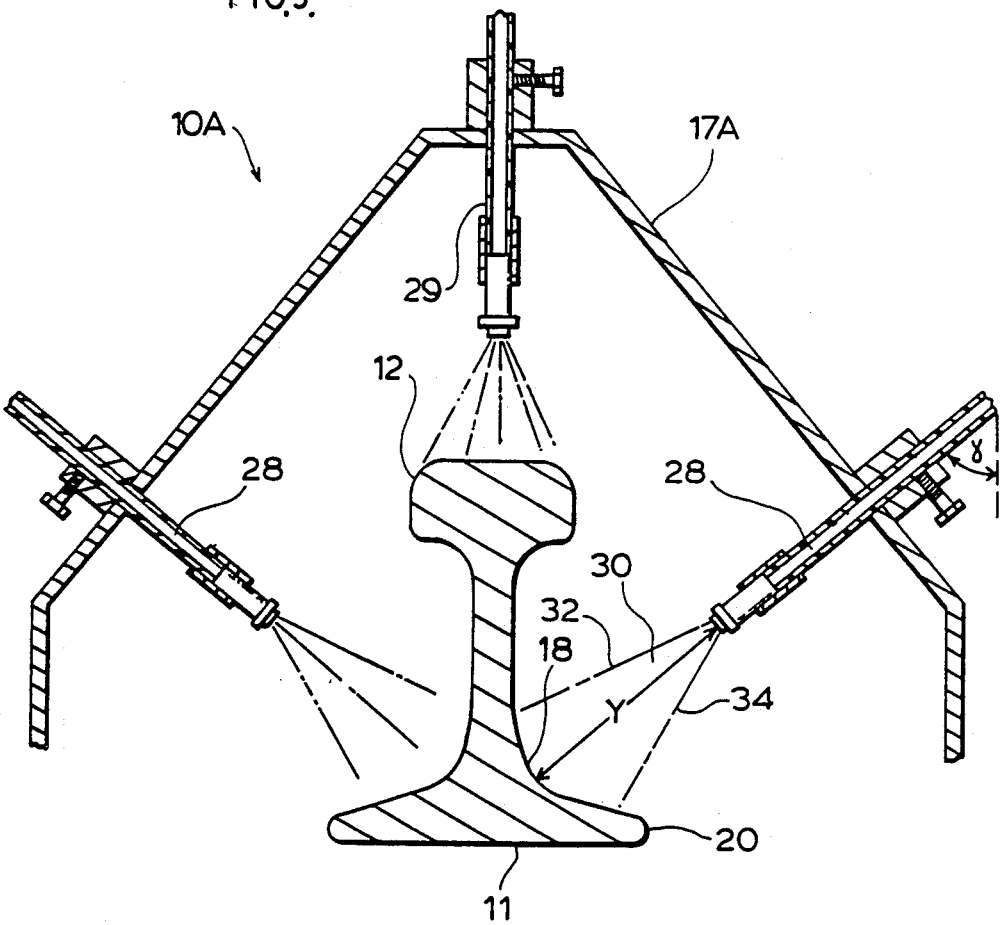
FIG. 3 illustrates an alternative embodiment of the apparatus of the present invention.

While in a preferred embodiment of the invention, shown in FIG. 1 and 2, the same nozzle is used to cool both the rail head and the web-base junction, in an alternative embodiment of the invention, shown in FIG. 3, separate nozzles are utilized.

Referring now to FIG. 3, alternative spray apparatus 10A comprises spray nozzles 28 mounted on shroud 17A, which spray an envelope of coolant shown generally as 30 onto a target area surrounding web-base junction 18 of rail 11. The envelope of coolant spray 30 is defined by rays 32 and 34. Nozzles 28 are set at a distance Y from the web-base junction and at an angle $\zeta$ from the vertical, distance Y angle $\zeta$, and the width of the envelope being selected so that coolant does not directly impinge upon the tips of the rail base 20 or too far up the web. Rail head nozzles 29 apply coolant spray to rail head 12.

An advantage of the alternative embodiment shown in FIG. 2 is greater process control flexibility. An additional degree of freedom is provided, since the web-base spray nozzles 28 can be adjusted independently of rail head nozzles 29, so as to optimize the cooling of the web-base junction independently of the rail head cooling. Also, it would be possible to place nozzles 28, in the case in which the subject invention is used with the AWC process described in U.S. Pat. No. 4,486,248, either in the head spray zones or in the air zones.

The ratio of relative cooling of the head portion of the rail as compared to the web-base junction of the rail may be selected so as to equalize the distribution of contractive forces in the head and base portions of the rail, and thus maintain the longitudinal straight shape of the rail during the accelerated cooling process, or to achieve a desired degree of camber as described above.

The term "accelerated cooling process" as defined herein is a broad term referring to the process of force cooling the rail head of a rail by a fluid cooling medium, at a rate which exeeds the cooling rate of still air cooling. In the above description, the present invention was described with reference to the accelerated cooling process described in Ackert, et al., which involves the cooling of a hot rail by subjecting the heated portion of the rail to intermittent forced cooling utilizing a liquid cooling medium, but it will be appreciated that the apparatus of the present invention may have application to other types of accelerated cooling procesess.

It will be appreciated that variations of the embodiments shown and described can be made without departing from the present invention, the scope of which is defined in the appended claims.

We claim:

1. A method for controlling the shape of a rail while the rail head of the rail is being subjected to an accelerated cooling process comprising the steps of applying a fluid coolant spray to a pre-selected target area surrounding the web-base junction of the rail during the accelerated cooling process, in such a manner that cooling of the top portion of the web is minimized and overcooling of the tips of the rail base is avoided to prevent the formation of martensite in the tips, wherein the amount of fluid coolant applied to the web-base junction is selected to achieve a desired degree of shape control.

2. The method of claim 1, wherein the web-base target area extends from a point about half way up the web of the rail to a point about half way to the toe of the rail.

3. The method of claim 1, wherein the fluid coolant spray is a liquid.

4. A method as described in claim 1, wherein the coolant spray orignates from a position above the rail head, so that the rail head shields the upper portion of the web from the direct impingement of coolant spray.

5. A method as described in claim 1, for use with an accelerated cooling process in which said rail is moved longitudinally through a plurality of spray zones and air zones, an air zone being interposed between each successive pair of spray zones, wherein the web-base target area is subjected intermittently to the coolant spray.

6. A method as described in claim 2, wherein the volume and the specific heat capacity of the coolant applied to the web-base target area are selected so that the quantity of heat removed from the web-base target area is approximately one quarter of that removed from the rail head during the accelerated cooling process.

7. The method of claim 3, wherein the liquid is ambient temperature water.

8. A method as described in claim 5, wherein the coolant spray is only applied to the web-base target area when the rail is in a spray zone.

9. A method as described in claim 5, wherein the coolant spray is applied to the web-base junction when the rail is in an air zone.

10. A method as described in claim 8, wherein the coolant spray is simultaneously applied to both the rail head and the web-base junction.

11. A method as described in claim 9, wherein the coolant spray is simultaneously applied to both the rail head and the web-base junction.

12. A method for controlling the longitudinal shape of the said rail while the rail head of the rail is being subjected to an accelerated cooling process involving subjecting the head portion of a rail to intermittent forced cooling by passing said rail through a series of alternating cooling headers utilizing a liquid cooling medium and air zones, in such a manner that the near surface region of said rail is maintained essentially above the martensite transformation temperature, comprising the step of applying a fluid coolant to the web-base junction of the rail during said intermittent forced cooling while minimizing the cooling of the upper web portion and the tips of the rail base of said rail.

* * * * *